US010969731B2

(12) United States Patent
Machii et al.

(10) Patent No.: US 10,969,731 B2
(45) Date of Patent: Apr. 6, 2021

(54) ELECTRICAL CONTACT SPRING AND ELECTRICAL CONTACT MEMBER TO BE USED FOR IMAGE FORMING APPARATUS AND IMAGE FORMING APPARATUS

(71) Applicant: CANON KABUSHIKI KAISHA, Tokyo (JP)

(72) Inventors: Emi Machii, Izu (JP); Masaki Seto, Gotemba (JP); Takashi Yano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/543,263

(22) Filed: Aug. 16, 2019

(65) Prior Publication Data

US 2020/0064772 A1 Feb. 27, 2020

(30) Foreign Application Priority Data

Aug. 24, 2018 (JP) ..... JP2018-157381

(51) Int. Cl.
*G03G 21/16* (2006.01)
*H01R 13/40* (2006.01)
*H01R 13/24* (2006.01)

(52) U.S. Cl.
CPC ..... *G03G 21/1652* (2013.01); *H01R 13/2421* (2013.01); *H01R 13/40* (2013.01)

(58) Field of Classification Search
CPC ..... G03G 21/1652; H01R 13/2421; H01R 13/2428; H01R 13/40
See application file for complete search history.

(56) References Cited

U.S. PATENT DOCUMENTS

| | | | | |
|---|---|---|---|---|
| 9,046,806 | B2 * | 6/2015 | Souda | G03G 21/1652 267/179 |
| 9,946,186 | B2 * | 4/2018 | Miyamoto | G03G 21/1652 |
| 2011/0065336 | A1 * | 3/2011 | Souda | G03G 21/1871 439/824 |
| 2014/0112679 | A1 * | 4/2014 | Choi | G03G 15/80 399/90 |
| 2015/0072543 | A1 * | 3/2015 | Willner | H01R 12/7076 439/81 |
| 2016/0076568 | A1 * | 3/2016 | Dilmaghanian | H01R 13/2421 403/271 |
| 2017/0373425 | A1 * | 12/2017 | Rust | H01R 13/2421 |
| 2018/0246461 | A1 * | 8/2018 | Nakayashiki | G03G 15/80 |

FOREIGN PATENT DOCUMENTS

JP 2011-64925 A 3/2011

* cited by examiner

*Primary Examiner* — Oscar C Jimenez
(74) *Attorney, Agent, or Firm* — Canon U.S.A., Inc., IP Division

(57) ABSTRACT

To achieve reliable electrical connection, a width of a ring shape portion becomes narrower toward a side closer to a compression spring portion in an axis direction of the compression spring portion, and an end portion of a winding start portion is located closer to a second end portion of the ring shape portion on a side opposite to the compression spring portion.

16 Claims, 12 Drawing Sheets

ELECTRICAL CONTACT SPRING AND ELECTRICAL CONTACT MEMBER TO BE USED FOR IMAGE FORMING APPARATUS AND IMAGE FORMING APPARATUS

BACKGROUND OF THE INVENTION

Field of the Invention

The present disclosure relates to an electrical contact spring and an electrical contact member to be used for an image forming apparatus and an image forming apparatus.

Description of the Related Art

Conventionally, an image forming apparatus such as a laser beam printer includes a process cartridge, a transfer unit, and a fixing unit. These units are electrically connected to a power supply board. There is a following configuration for reliably establishing electrical connection while facilitating assembly and maintenance of these units.

As illustrated in FIG. 10, a power supply line 802 has a contact portion 802*c* having a circular shape formed by bending and raising an end portion of a compression spring 802*b* provided at an end portion of the power supply line 802 to form a double loop in a shape of an ellipse. As illustrated in FIG. 11A, the contact portion 802*c* protrudes from a through hole 807*a* of a holding member 807, and is pressurized to be in contact with a contact portion 802 of another unit. Providing such a configuration can ensure electrical connection without impairing attachment/detachment workability of a unit in, for example, a user operation or a service. Such a configuration is also discussed in, for example, Japanese Patent Application Laid-Open No. 2011-64925.

However, if a plurality of power supply lines tangles when being handled, a load is applied to the contact portion 802*c* that is bent and raised. In such a situation, there may be a case where a wire material 802*c*1 of the first loop climbs over a wire rod 802*c*2 of the second loop, i.e., the wire rods of the double-loop portion intersect with each other. At this time, the thickness and the width of the circular shape of the contact portion 802*c* are larger than those in a case where the wire rods do not intersect with each other, by at least the wire diameter of the wire rod. Then, as illustrated in FIG. 11B, the wire rods 802*c*1 and 802*c*2 are caught in the through hole 807*a* of the holding member 807 by interfering with the through hole 807*a*, so that contact with the contact portion of the other unit by a predetermined pressure cannot be achieved. This can lead to unstable electrical connection, so that the other unit may not operate properly.

Therefore, a contact configuration that enables reliable electrical connection is desired.

SUMMARY OF THE INVENTION

According to an aspect of the present disclosure, an electrical contact spring for an image forming apparatus, includes a compression spring portion formed of a coiled wire rod and configured to be compressed and deformed, and a contact portion having a circular shape and provided on one side of the compression spring portion in an axis direction thereof, wherein the contact portion has a ring shape portion, which is formed of the wire rod wound into at least a double loop around a direction intersecting the axis direction, and a winding start portion, which is formed of the wire rod and connects the compression spring portion and the ring shape portion, wherein the ring shape portion has a first end portion on a side of the compression spring portion and a second end portion on a side opposite to the compression spring portion in the axis direction, and in a case where a position halving a straight line connecting the first end portion and the second end portion is a center, a width of the ring shape portion becomes narrower from the center to a side closer to the compression spring portion in the axis direction, and wherein when viewed in the intersecting direction, an end portion of the winding start portion located on a side opposite to the compression spring portion is located at a position closer to the second end portion of the ring shape portion than to the first end portion of the ring shape portion.

According to another aspect of the present disclosure, an electrical contact spring for an image forming apparatus, includes a compression spring portion formed of a coiled wire rod and configured to be compressed and deformed, and a contact portion having a circular shape and provided on one side of the compression spring portion in an axis direction thereof, wherein the contact portion has a ring shape portion formed of the wire rod wound into at least double loops in a direction intersecting the axis direction, and wherein a region including an overlap of the wire rod of the ring shape portion is 70% or less of the entire ring shape portion when viewed in the intersecting direction.

Further, an electrical contact member and an image forming apparatus are provided.

Further features of the present disclosure will become apparent from the following description of exemplary embodiments with reference to the attached drawings.

DESCRIPTION OF THE EMBODIMENTS

Specific examples of exemplary embodiments applied to an image forming apparatus of electrophotographic type will be described below with reference to the drawings. The dimensions, shapes, and relative positions of components described in the exemplary embodiments are not intended to limit the scope of the invention to these, unless otherwise specified.

A first exemplary embodiment will be described. An electrical contact configuration will be described below with reference to FIGS. 1A to 8 and 12.

<Image Forming Apparatus>

An overall configuration of an image forming apparatus will be described together with image forming operation, with reference to the drawings. The dimensions, materials, shapes, and relative positions of components to be described below are not intended to limit the scope of the invention to these, unless otherwise specified.

The image forming apparatus according to the present exemplary embodiment is an image forming apparatus of electrophotographic type. The image forming apparatus performs image formation by transferring toners of four colors of yellow Y, magenta M, cyan C, and black K to an intermediate transfer belt and then transferring an image to a sheet of a material such as paper. In the following description, a member using the above-described toner of each color is appropriately provided with the corresponding one of Y, M, C, and K as a subscript. However, since the members are substantially the same in terms of configuration and operation except that the colors of the toners to be used are different, the subscripts are omitted as appropriate except in a case where distinction is necessary.

Figure 12:
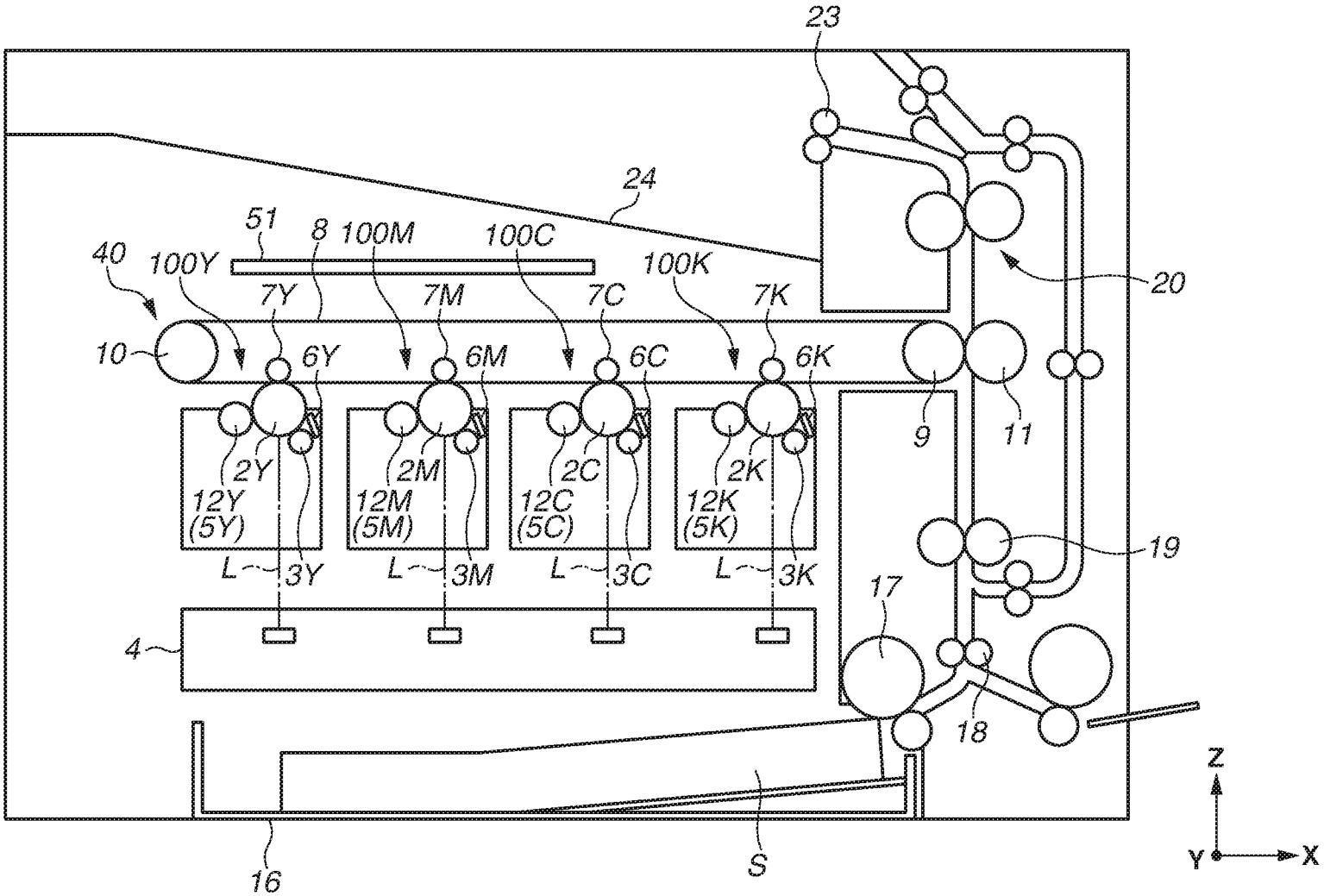
FIG. 12 is a diagram illustrating an image forming apparatus.

As illustrated in FIG. 12, the image forming apparatus includes an image forming unit for forming an image by transferring a toner image onto a sheet of a material such as paper, a sheet feeding unit for feeding the sheet toward the image forming unit, and a fixing unit for fixing the toner image to the sheet.

The image forming unit includes a photosensitive drum 2 (2Y, 2M, 2C, and 2K) as a photosensitive member, a charging roller 3 (3Y, 3M, 3C, and 3K) as a charging unit for charging the surface of the photosensitive drum 2, and a developing device 5 (5Y, 5M, 5C, and 5K) as a developing unit. The image forming unit further includes a primary transfer roller 7 (7Y, 7M, 7C, and 7K) as a transfer unit, a laser scanner unit 4 as an exposure unit, a cleaning blade 6 (6Y, 6M, 6C, and 6K), and an intermediate transfer unit 40. The photosensitive drum 2, the charging roller 3, and the developing device 5 are unitized to be a process cartridge 100 that is detachably attached to the main body of the image forming apparatus.

The intermediate transfer unit 40 includes the intermediate transfer belt 8, a secondary transfer roller 11, a secondary transfer opposing roller 9, and a tension roller 10. The intermediate transfer belt 8 is an endless belt stretched around the secondary transfer opposing roller 9 and the tension roller 10, and circulates following the rotation of the secondary transfer opposing roller 9 driven by a driving force of a drive source.

Next, the image forming operation will be described. First, when a control unit (not illustrated) receives an image forming job signal, sheets S stacked in a sheet stacking unit 16 are sent one by one, by a feed roller 17, a conveyance roller 18, and a registration roller 19, into a secondary transfer portion formed by the secondary transfer roller 11 and the secondary transfer opposing roller 9.

Meanwhile, in the image forming unit, at first, the surface of the photosensitive drum 2 serving as the photosensitive member is uniformly charged by application of a charging bias to the charging roller 3 serving as the charging unit. Then, the laser scanner unit 4 serving as the exposure unit performs exposure by irradiating the surface of the photosensitive drum 2 of each color with a laser beam L, based on image data transmitted from an apparatus such as an external apparatus (not illustrated). In this way, the laser scanner unit 4 serving as the exposure unit exposes the photosensitive drum 2 serving as the photosensitive member, so that an electrostatic latent image is formed on the surface of the photosensitive drum 2.

Then, a development bias is applied to a developing sleeve 12 (12Y, 12M, 12C, and 12K) of the developing device 5 serving as the developing unit. With this application, the toner of each color adheres to the electrostatic latent image formed on the surface of the photosensitive drum 2 by the laser scanner unit 4 serving as the exposure unit. In this way, a toner image is formed on the surface of the photosensitive drum 2.

Next, a primary transfer bias is applied to the primary transfer roller 7 serving as the transfer unit, so that each of the toner images formed on the surface of the photosensitive drum 2 is primary transferred to the intermediate transfer belt 8 serving as a transfer receiving member. In this way, a full-color toner image is formed on the surface of the intermediate transfer belt 8 serving as the transfer receiving member. After the primary transfer, the cleaning blade 6 scrapes off the toner adhering to the surface of the photosensitive drum 2.

The toner image is then sent to the secondary transfer portion by the circulation of the intermediate transfer belt 8 serving as the transfer receiving member. Subsequently, a second transfer bias is applied to the secondary transfer roller 11 in the secondary transfer portion, so that the toner image on the intermediate transfer belt 8 serving as the transfer receiving member is transferred to the sheet S.

Next, the sheet S on which the toner image has been transferred is heated and pressurized in a fixing device 20, so that the toner image on the sheet S is fixed onto the sheet S. The sheet S on which the toner image is fixed is then discharged to a discharge portion 24 by a discharge roller 23 of the image forming apparatus.

<Electrical Contact Configuration>

Figure 4:
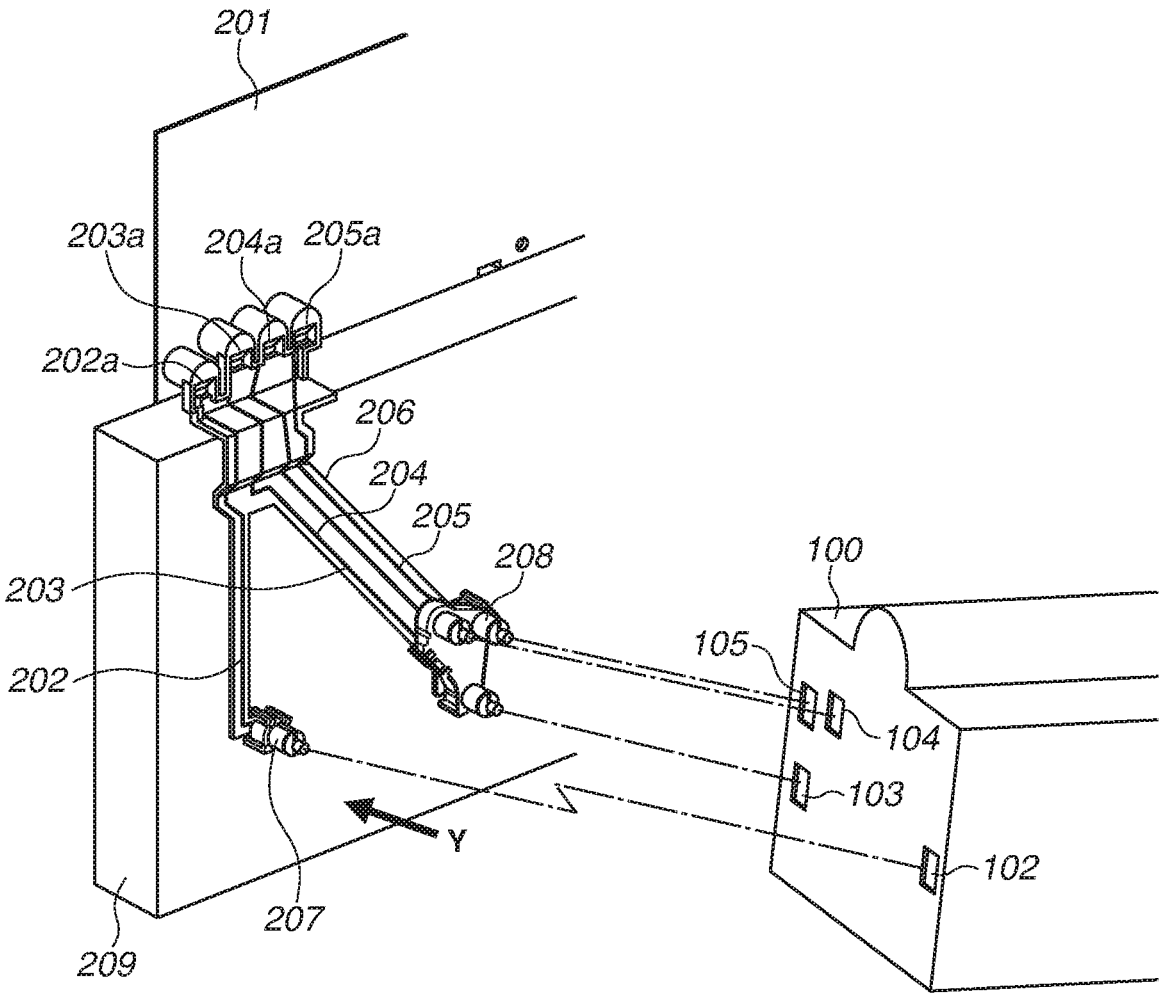
FIG. 4 is a perspective diagram illustrating an electrical contact configuration in an image forming apparatus according to the first exemplary embodiment.

FIG. 4 is a perspective diagram illustrating an electrical contact configuration within the image forming apparatus of electrophotographic type, according to the present exemplary embodiment. The electrical contact configuration includes a high-voltage power supply board 201 that supplies a high-voltage, power supply lines 202, 203, 204, and 205, and a power supply line holder 206 that holds each of the power supply lines 202, 203, 204, and 205 at a fixed position. The electrical contact configuration further includes caps 207 and 208 that each of these protects a contact portion of corresponding one of the power supply lines 202, 203, 204, and 205 for the process cartridge 100. The electrical contact configuration further includes a drive unit 209, and the power supply line holder 206 disposed to detour the drive unit 209. Compression springs 202*a*, 203*a*, 204*a*, and 205*a* are provided at the end portions on the high-voltage power supply board 201 side of the respective power supply lines 202, 203, 204, and 205. The power supply lines 202, 203, 204, and 205 are held by the power supply line holder 206 serving as a holding member so that the power supply lines 202, 203, 204, and 205 are urged toward the high-voltage power supply board 201 by a predetermined urging force caused by an elastic force of the compression springs 202*a*, 203*a*, 204*a*, and 205*a*.

Next, the shape of the end portion on the process cartridge 100 side of the power supply line will be described with reference to FIGS. 1A, 1B, 5A, 5B, and 6, by using the power supply line 202 as an example.

Figure 1A:
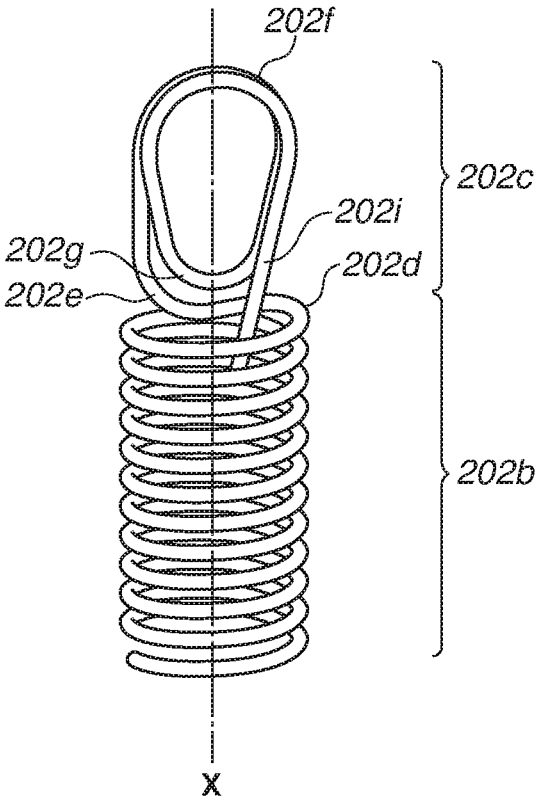
FIGS. 1A and 1B are diagrams illustrating a shape of each of a compression spring portion and a circular contact portion according to a first exemplary embodiment.
Figure 1B:
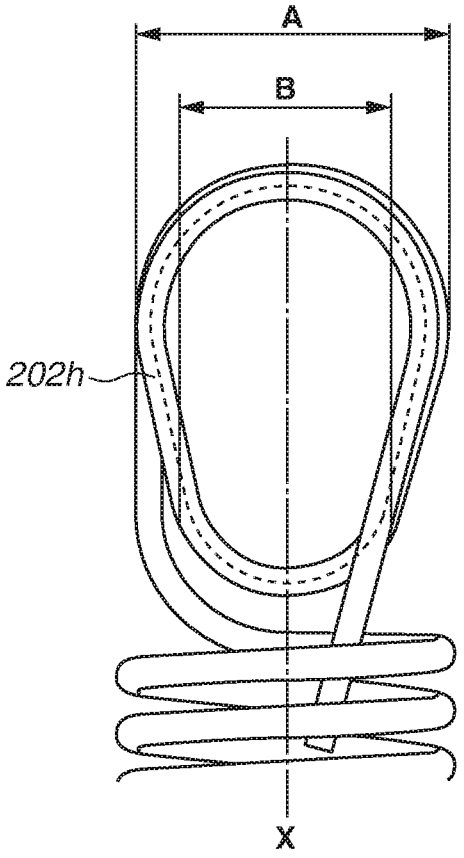

FIGS. 1A and 1B are diagrams each illustrating the end portion on the process cartridge 100 side of the power supply line 202. The end portion of the power supply line 202 is provided with an electrical contact spring. The electrical contact spring has a compression spring portion 202*b* serving as a compression spring portion that is formed of a compression deformable coiled wire rod that is compression deformable. The electrical contact spring further has a circular contact portion 202*c* that is provided ahead of the compression spring portion 202*b*, on one end portion side of the compression spring portion 202*b* in the axis direction of a central axis X of the compression spring portion 202*b*. The contact portion 202*c* has a ring shape portion. The ring shape portion is formed by winding the wire rod of the compression spring portion 202*b* into at least a double loop around a direction intersecting the axis direction.

Figure 5A:
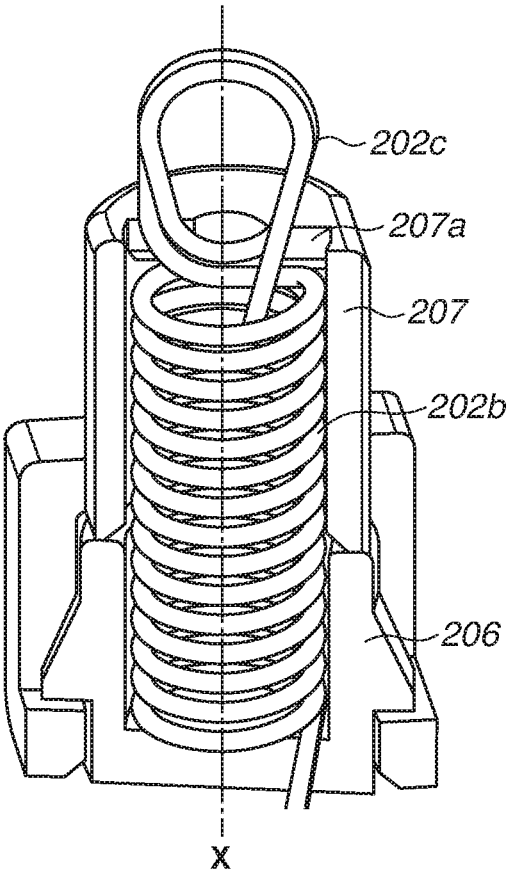
FIGS. 5A and 5B are diagrams illustrating a configuration for holding the circular contact portion according to the first exemplary embodiment.
Figure 5B:
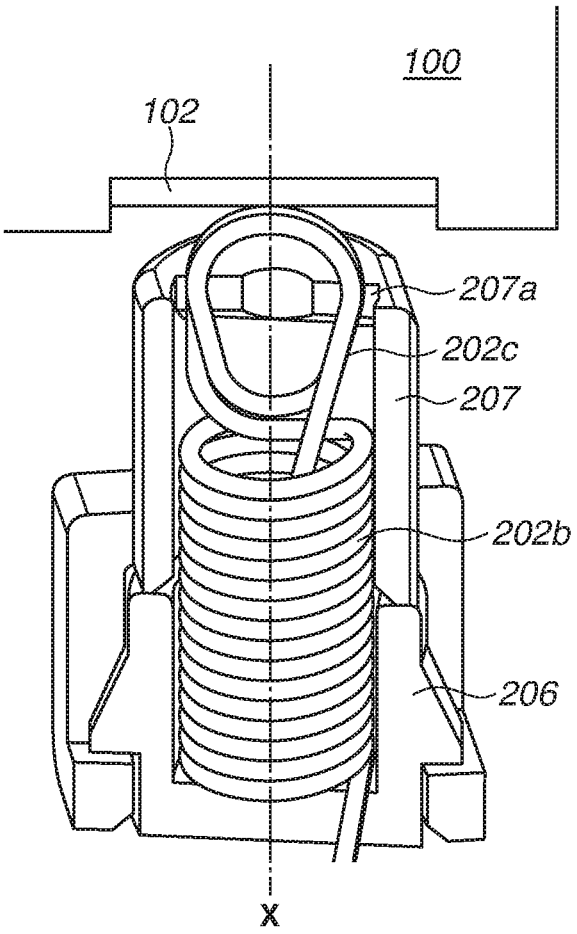
Figure 6:
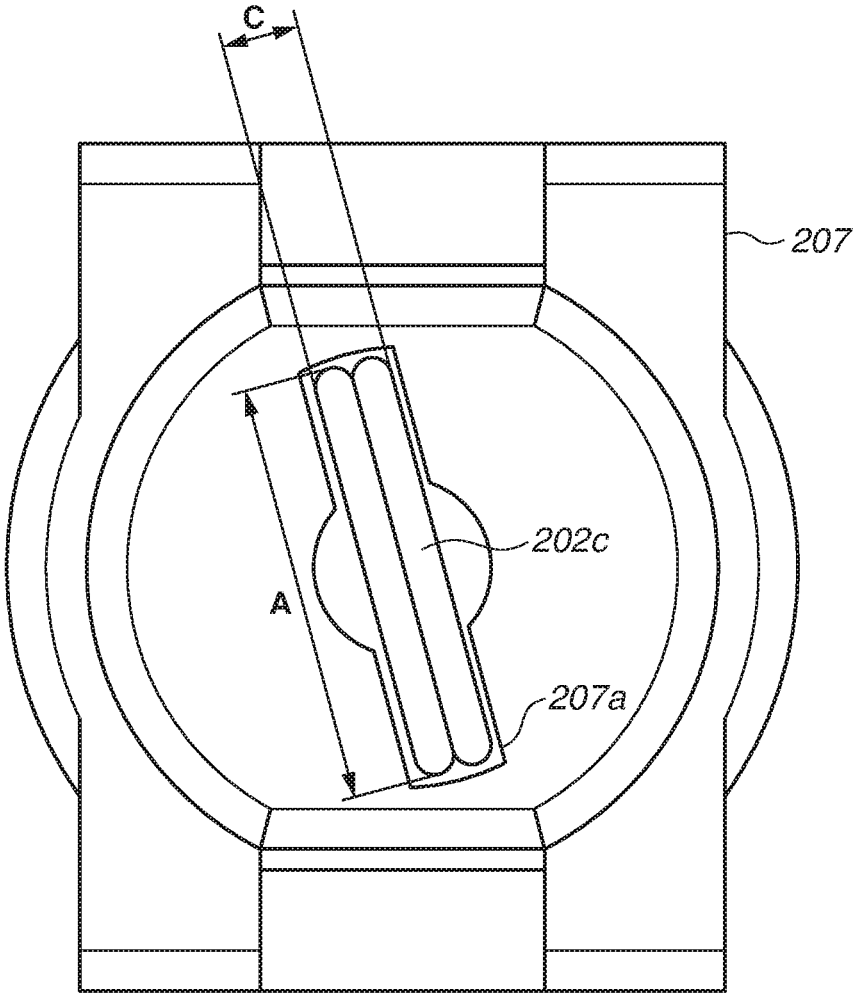
FIG. 6 is a diagram illustrating the configuration for holding the circular contact portion according to the first exemplary embodiment.

FIGS. 5A, 5B, and 6 illustrate a configuration for holding the end portion on the process cartridge 100 side of the power supply line 202, using the power supply line holder 206 and the cap 207. In the present disclosure, a configuration having an electrical contact spring and a holding member is an electrical contact member. FIGS. 5A and 5B are enlarged views of a portion around the cap 207 serving as the holding member in FIG. 4. For easy understanding of the configuration, part of the power supply line holder 206 and the cap 207 is not illustrated in FIGS. 5A and 5B. FIG. 5A illustrates a state where the process cartridge 100 is not attached, and FIG. 5B illustrates a state where the process cartridge 100 is attached at a predetermined position. FIG. 6 is a diagram illustrating a portion around the cap 207 as viewed from an arrow-Y direction in FIG. 4.

As illustrated in FIG. 5A, the compression spring portion 202*b* serving as the compression spring portion on the process cartridge 100 side of the power supply line 202 formed of the wire rod is contained and held in a compression deformable manner by the power supply line holder 206 and the cap 207 serving as the holding member. In addition, as illustrated in FIG. 6, a rectangular slit hole 207*a* is formed in the cap 207 serving as the holding member, so that the circular contact portion 202*c* formed of the wire rod wound into the a double loop is held to be slidable in the central axis X direction (axis direction) of the compression spring portion 202*b*.

When the process cartridge 100 is attached at the predetermined position as illustrated in FIG. 5B, the circular contact portion 202*c* is in contact with and urged toward a contact portion 102 of the process cartridge 100. The compression spring portion 202*b* is compressed, so that the contact portion 202*c*, which is formed of the wire rod wound into the a double loop and provided on the one end portion side of the compression spring portion 202*b*, retracts into the inside of the cap 207 by sliding in the central axis X direction (axis direction). Between the circular contact portion 202*c* provided on the one end portion side of the compression spring portion 202*b* and the contact portion 102 of the process cartridge 100, the urging force exerted by the elastic force of the compression spring portion 202*b* becomes a contact pressure, so that electrical continuity is established.

At this time, in a case where a force is exerted on the circular contact portion 202*c* in a direction other than the central axis X direction and thereby the circular contact portion 202*c* is about to tilt, the movement of the circular contact portion 202*c* is regulated by the rectangular slit hole 207*a*. In other words, the rectangular slit hole 207*a* has a size that enables the a double loop formed of the wire rod of the circular contact portion 202*c* and having a width A and a thickness C to be fit in the rectangular slit hole 207*a*. This prevents the circular contact portion 202*c* from leaning in a direction different from the central axis X direction or deforming due to the elastic force of the compression spring portion 202*b*. In this way, no contact failure occurs.

Next, the shape of the electrical contact spring will be described in detail with reference to FIGS. 1A and 1B. The electrical contact spring has the compression spring portion and the circular contact portion. The circular contact portion 202*c* includes a ring shape portion 202*h* shaped like a ring, a winding start portion 202*e*, and a winding end portion 202*i*. The winding start portion 202*e* is a portion between a spring end portion 202*d* of the compression spring portion 202*b* and the ring shape portion 202*h*. First, the spring end portion 202*d* of the compression spring portion 202*b* is bent so that the winding start portion 202*e* extends in a direction toward the center of the cylindrical portion of the compression spring portion 202*b*. The winding start portion 202*e* further extends, and is subsequently bent at an angle of about 90 degrees on the opposite side on the circular portion of the compression spring portion 202*b* to rise in a direction away from the compression spring portion 202*b* while forming an R-shape in the central axis X direction of the compression spring portion 202*b*. The R-shape has about the same radius r as the radius r of the compression spring portion 202*b*. Continuous therefrom is the ring shape portion 202*h* formed of the same wire rod as that of the winding start portion 202*e*. In the ring shape portion 202*h* formed of the wire material, a U-shaped portion 202*f* is formed in a substantially semi-ellipse shape, and a U-shaped portion 202*g* is also formed therefrom, on the side close to the compression spring portion 202*b*. A width B of the U-shaped portion 202*g* on the side close to the compression spring portion 202*b* is smaller than a width A of the U-shaped portion 202*f* on the side away from the compression spring portion 202*b*. The two U-shaped portions 202*g* and 202*f* form the ring shape portion 202*h* (indicated by a broken line in FIG. 1B). The ring shape portion 202*h* is a portion forming a ring in the circular contact portion 202*c*. The winding end portion 202*i* of the circular contact portion 202*c* is a portion formed continuously from the ring shape portion 202*h* up to the end portion of the rod wire. The winding end portion 202*i* protrudes to the inside of the cylindrical portion of the cylindrical shape of the compression spring portion 202*b*, while extending along one side of the ring shape of the contact portion 202*c*. In this way, even if an external force is applied, the winding end portion 202*i* is brought into contact with the cylindrical portion of the compression spring portion, so that the winding end portion 202*i* is prevented from protruding from the cylindrical portion.

In the first exemplary embodiment, even in a case where an external force acts on the wire rod of the contact portion 202*c* due to handling, the wire rod of the first loop and the wire rod of the second loop do not intersect with each other to run on, as compared with a conventional configuration. The reason for this is as follows. On the left part of the contact portion 202*c* relative to the central axis X of the compression spring portion 202*b* in FIG. 1A, in a case where a situation that the second loop intersects with the first loop by moving inward due to an external force occurs as in a conventional case, a contact area between the wire rods is small, because the first loop and the second loop take different routes. Therefore, the first loop and the second loop cannot maintain the intersecting state and thus these loops return to the original form. In addition, on the right part relative to the central axis X of the compression spring, in a case where a load is applied by an external force, the first loop and the second loop move together, so that no running-on occurs. Therefore, the width A and the thickness C of the circular contact portion do not increase. As a result, it is possible to provide an electrical contact member that prevents occurrence of a contact failure that can occur when a desired contact pressure is not obtained due to interference between the circular contact portion and the slit hole 207*a* of the holding member.

As described above, because the first loop and the second loop take the different routes, the contact area between the wire rods is small, so that the first loop and the second loop cannot maintain the intersecting state and thus these loops return to the original form. The shape when viewed from a point different from this point of view will be described below.

Figure 2:
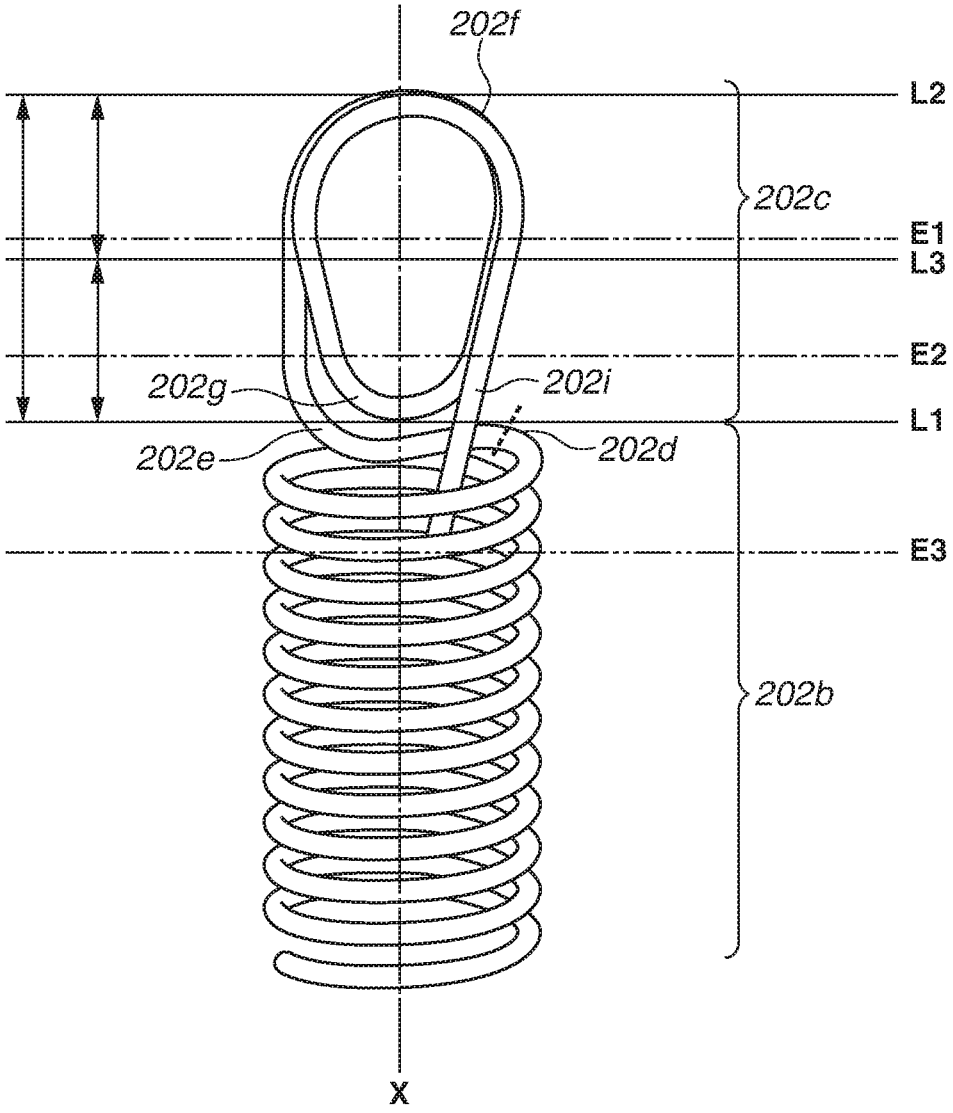
FIG. 2 is a diagram illustrating the shape of each of the compression spring portion and the circular contact portion according to the first exemplary embodiment.

The configuration of the end portion will be described in detail with reference to FIGS. 2 and 3. The compression spring portion 202*b* serving as the compression spring portion is formed of the coiled wire rod. Therefore, the compression spring portion is cylindrical, and is configured to have the cylindrical portion having a cavity therein. Thus, part of the winding end portion of the contact portion can enter the inside of the cylindrical portion. The compression spring portion in the present specification is a portion up to the winding end portion of the coiled compression spring. The part up to a portion indicated with a dotted line illustrated in FIG. 2 is the compression spring portion. The portion beyond the dotted line in FIG. 2 is the contact portion.

The contact portion has the ring shape portion 202*h* formed of the wire rod wound into at least a double loop, the winding start portion 202*e* where the winding of the ring shape portion starts, and the winding end portion 202*i* formed of the wire rod continuous from the ring shape portion.

Figure 3:
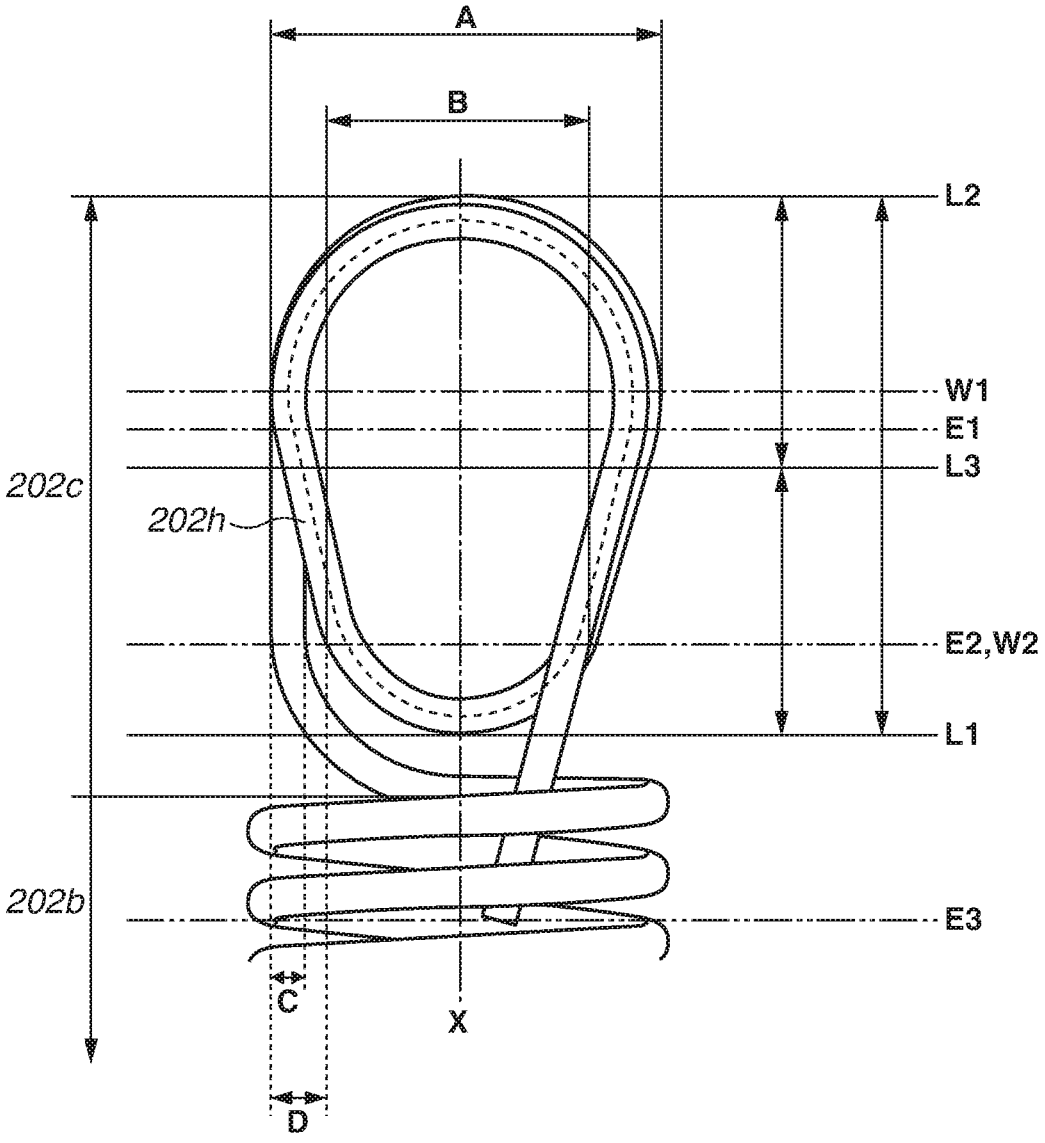
FIG. 3 is a diagram illustrating the shape of each the compression spring portion and the circular contact portion according to the first exemplary embodiment.
Figure 8:
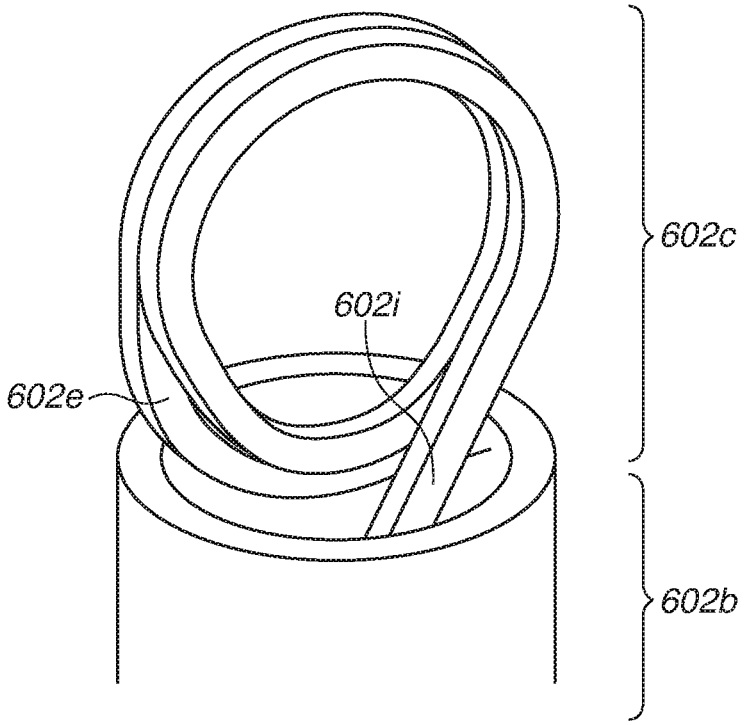
FIG. 8 is a diagram illustrating another example of the shape of the circular contact portion.

In the present exemplary embodiment, the wire rod corresponding to the ring shape indicated with a broken line illustrated in FIG. 3 is the ring shape portion of the contact portion. The ring shape portion has a portion where the wire rods overlap. This overlapping portion occupies a region corresponding to 70% of the entire ring shape portion, when viewed in a direction intersecting the axis direction (direction orthogonal to the axis direction in FIG. 3). In a modification example illustrated in FIGS. 9A and 9B, the wire rods of the a double loop overlap in a region corresponding to 50% of the entire ring shape portion, when viewed in a direction intersecting the axis direction (direction orthogonal to the axis direction in FIGS. 9A and 9B). In FIG. 8, the wire rods overlap in a region corresponding to about 80% of the entire ring shape portion, and the larger the overlapping region is, the larger the contact area is and an issue is more likely to occur. Therefore, 70% or less is desirable. As for the border between the winding start portion and the ring shape portion, the portion where the wire rods overlap is the ring shape portion and a portion where the wire rods do not overlap is the winding start portion, when viewed in the direction intersecting the axis direction (direction orthogonal to the axis direction in FIG. 3). Therefore, the tip on the ring shape portion side of the winding start portion is located on a straight line E1 in FIG. 3. Similarly, as for the border between the winding end portion and the ring shape portion, the portion where the wire rods overlap is the ring shape portion and a portion where the wire rods do not overlap is the winding end portion, when viewed in the direction intersecting the axis direction (direction orthogonal to the axis direction in FIG. 3). Therefore, the tip on the ring shape portion side of the winding end portion is located on a straight line E2.

The compression spring portion and the contact portion are continuously formed of the same wire rod. In the present exemplary embodiment, the winding start portion of the contact portion is configured to connect the compression spring portion and the ring shape portion. The winding start portion extends from the end portion of the compression spring portion in the direction intersecting the axis direction (X direction), and subsequently rises at a midpoint to extend in the axis direction. The winding start portion subsequently connects to the ring shape portion. The position of the tip of the winding start portion (or the position on the straight line E1) in the axis direction of the compression spring portion is as follows. First, between the end portions of the ring shape portion of the contact portion in the axis direction of the compression spring portion, the end portion on the compression spring portion side is a first end portion (position through which a straight line L1 passes), and the end portion on the side opposite to the compression spring portion is a second end portion (position through which a straight line L2 passes). Further, a point that halves a straight line connecting the first end portion and the second end portion in the axis direction (position through which a straight line L3 passes) is the center of the ring shape portion. In this case, the end portion on the side opposite to the compression spring portion of the winding start portion is located on the second end portion (straight line L2) side of the ring shape portion, relative to the center (straight line L3) of the ring shape portion in the axis direction. In other words, the end portion on the side opposite to the compression spring portion of the winding start portion is located at a position closer to the second end portion of the ring shape portion than to the first end portion of the ring shape portion, when viewed in the direction intersecting the axis direction. In FIG. 3 as well, between the tips of the winding start portion, the tip located on the side opposite to the compression spring portion of the winding start portion is located above the straight line L3 or the center of the ring shape portion and below the straight line L2 or the second end portion of the ring shape portion, in the axis direction. Of the widths of the ring shape portion in the present exemplary embodiment, the width A at a straight line W1 illustrated in FIG. 3 is the maximum, and becomes smaller toward the side closer to the compression spring portion, in the axis direction. For example, the width B illustrated in FIG. 3 is smaller than the width A of the ring shape portion. In addition, when the width of the ring shape portion at the position on the straight line W1 and the width of the ring shape portion at the position on a straight line W2 are compared, there is a variation, i.e., a width D longer than the thickness C of the wire rod. The winding end portion is formed of the wire rod continuously from the ring shape portion, and the tip on the ring shape portion side is located on the straight line E2 and extends toward the compression spring portion. The tip on the opposite side is located inside the cylindrical portion of the compression spring portion, and is located on a straight line E3 in FIG. 3.

Figure 7:
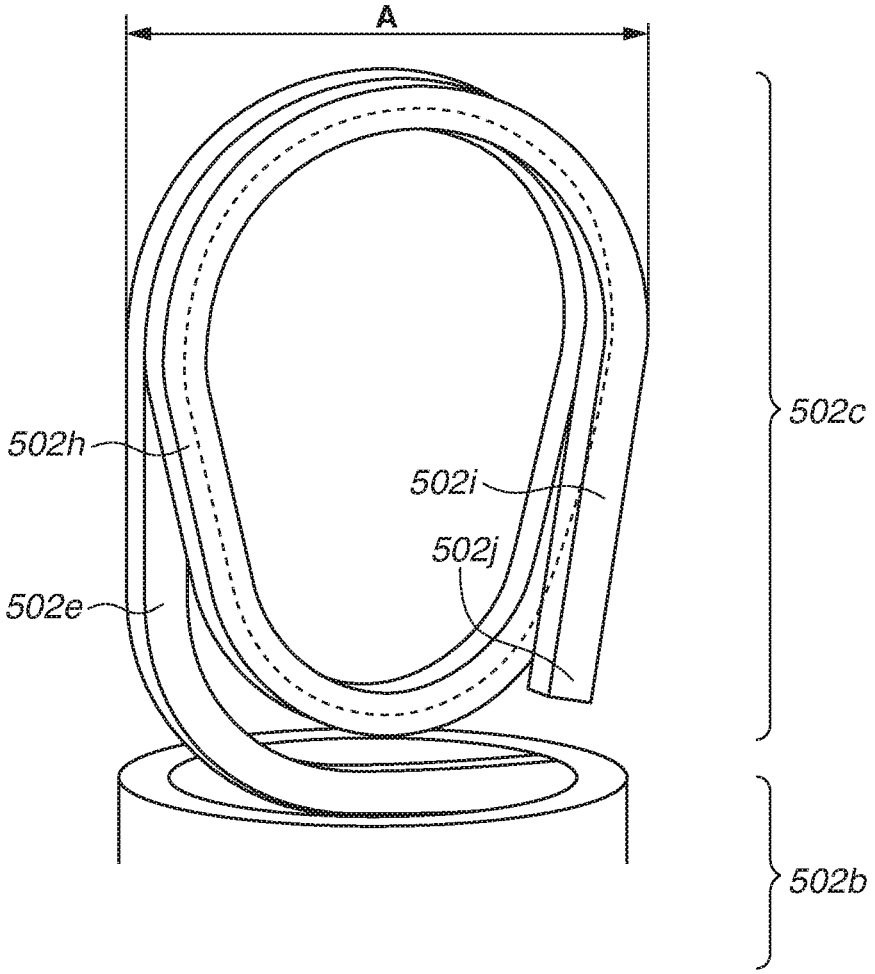
FIG. 7 is a diagram illustrating another example of the circular contact portion according to the first exemplary embodiment.

The shape of the circular contact portion 202*c* described above is the example in which the first loop and the second loop do not intersect with each other. As illustrated in FIG. 7, a configuration may be employed in which an end portion 502*j* of a wire rod of a winding end portion 502*i* of a circular contact portion 502*c* is located at a position where the end portion 502*j* does not reach a compression spring portion 502*b* in the outside of the compression spring portion 502*b*.

In such a case, the width of a ring shape portion 502*h* is larger on the side away from the compression spring portion 502*b* than on the side close to the compression spring portion 502*b*. Further, the end portion 502*j* of the wire rod is located inside a maximum width A of the ring shape portion 502*h* and on the side closer to the compression spring portion 502*b* than the maximum width A, and a winding start portion 502*e* is located outside the ring shape portion 502*h*. In this way, the state where the first loop and the second loop intersect with each other when a load is applied by an external force is not maintained, so that an effect similar to the above-described effect can be obtained.

Furthermore, in the present exemplary embodiment, the ellipse shape is described as an example of the shape of the circular contact portion, but the present exemplary embodiment is not limited to this example. As illustrated in FIG. 8, a circular contact portion 602*c* may have a shape close to a perfect circle. If the width of the ring shape portion is larger on the side away from a compression spring portion 602*b* than on the side close to the compression spring portion 602*b*, and a winding start portion 602*e* and a winding end portion 602*i* are shaped to follow the ring shape or located outside the ring shape, a similar effect can be obtained by this shape as well.

The configuration in which the contact portion is provided in the process cartridge and is to be in contact with the high-voltage electrical contact portion for supplying a high voltage from the power supply line from the high-voltage power supply board is described above as an example, but the present exemplary embodiment is not limited to this example. A similar effect can be obtained for an electrical contact portion and a ground contact portion for other unit or component as well.

Figure 9B:
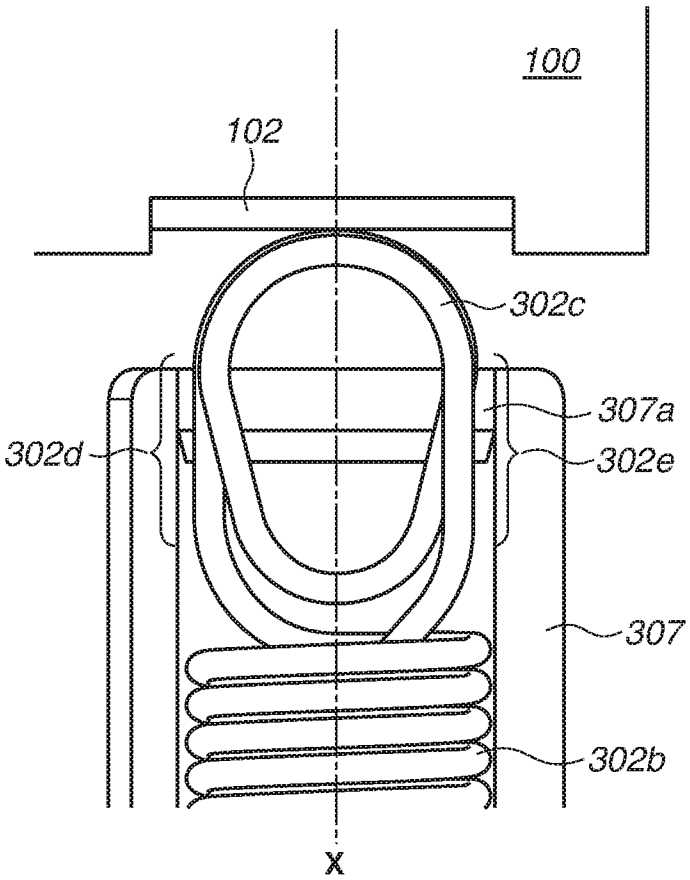
FIGS. 9A and 9B are diagrams illustrating a configuration of a circular contact portion according to a second exemplary embodiment.
Figure 9A:
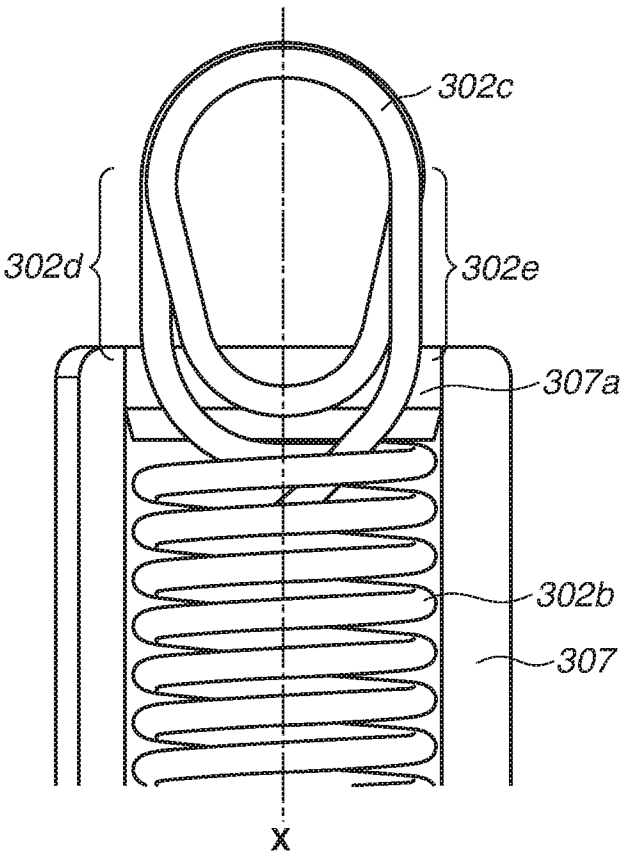
Figure 10:
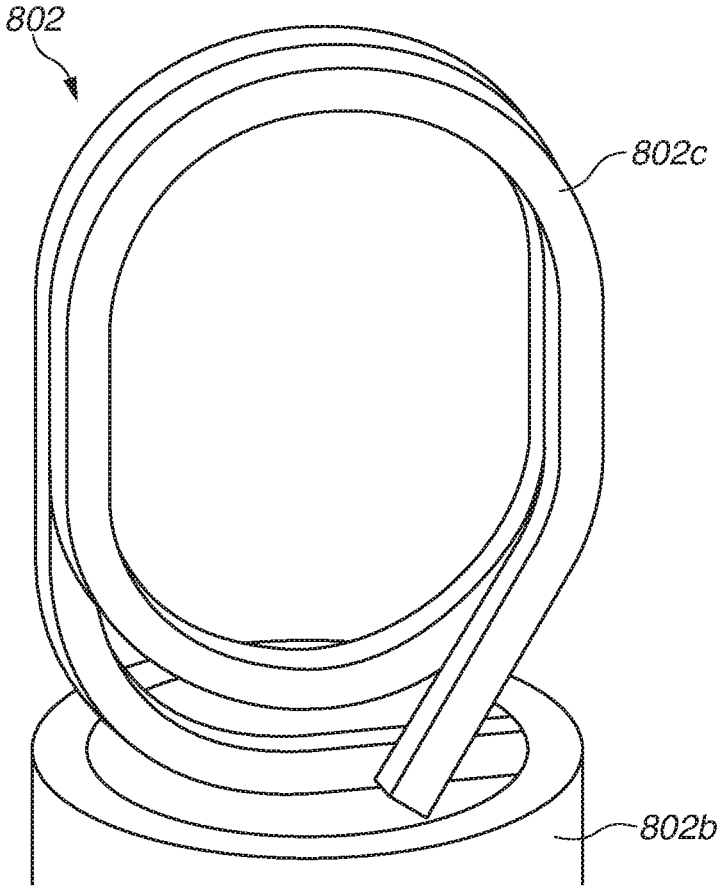
FIG. 10 is a diagram illustrating an electrical connection configuration of a conventional example.
Figure 11B:
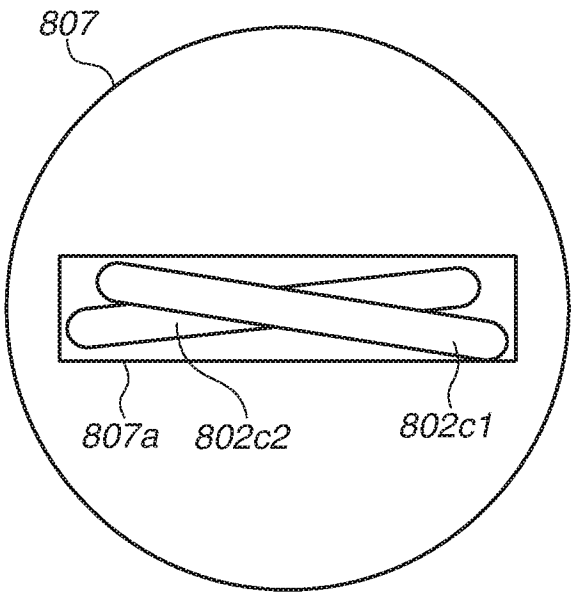
FIGS. 11A and 11B are diagrams illustrating an electrical connection configuration of the conventional example.
Figure 11A:
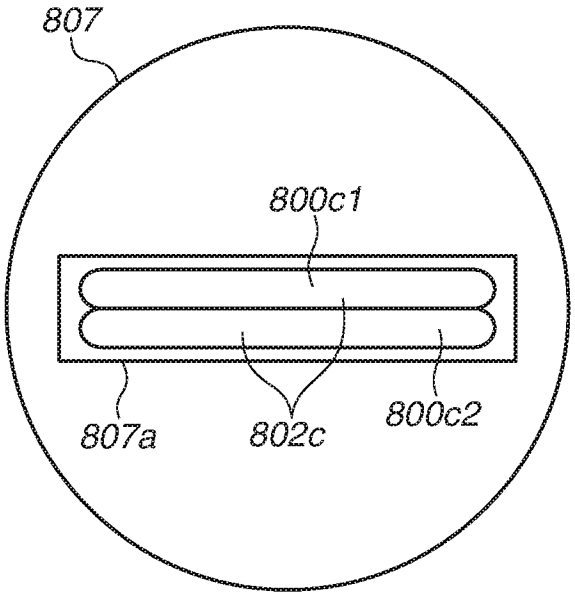

A second exemplary embodiment will be described. FIGS. 9A and 9B are diagrams illustrating details of a portion where a power supply line 302 electrically connects to the process cartridge 100. In FIGS. 9A and 9B, a part of a cap 307 serving as a holding member is not illustrated, for easy understanding of an electrical contact spring and a configuration of an electrical contact member having the electrical contact spring and the holding member. FIG. 9A illustrates a state where the process cartridge 100 is not attached. FIG. 9B illustrates a state where the process cartridge 100 is attached at a predetermined position, and a compression spring portion 302*b* serving as a compression spring portion that is compression deformable is compressed. The ring shape of a circular contact portion 302*c* in FIGS. 9A and 9B is similar to that in the first exemplary embodiment, and the width of the ring shape portion is larger on the side away from the compression spring portion than on the side close to the compression spring portion. Further, a part of a winding start portion 302*d* and a part of a winding end portion 302*e* are parallel with a central axis X direction (axis direction) of the compression spring portion 302*b*, and are located to face each other across the central axis X direction. The cap 307 serving as the holding member contains therein the compression spring portion 302*b* that is a part of the electrical contact spring, allows a part of the contact portion 302*c* to protrude, and holds other part of the contact portion 302*c*. The electrical contact member includes the cap 307 serving as the holding member, and the electrical contact spring that is partially contained in and held by the holding member. Further, as illustrated in FIG. 9A, a part of the winding start portion 302*d* and a part of the winding end portion 302*e* have been slidably fit into a slit hole 307*a* of the cap 307 serving as the holding member, since before the process cartridge 100 is attached. Therefore, the winding start portion and the winding end portion serving as the contact portion protrudes from the cap 307 serving as the holding member, in a state where the process cartridge is not attached. Further, as illustrated in FIG. 9B, the part of the winding start portion 302*d* and the part of the winding end portion 302*e* are slidably fit into the slit hole 307*a* of the cap 307 serving as the holding member, also when the process cartridge 100 is attached at the predetermined position.

According to the second exemplary embodiment, in a case where an external force acts on the wire rod of the circular contact portion 302*c* due to handling, the wire rod of the first loop and the wire rod of the second loop do not intersect with each other to run on, as with the first exemplary embodiment. Further, the circular contact portion has been guided in the central axis X direction by the slit hole 207*a* since before the attachment. Therefore, even in a case where the contact portion 102 on the process cartridge side approaches from a diagonal direction relative to the central axis X direction, the circular contact portion can stably slide without leaning in a direction different from the central axis X direction and without deforming, so that no contact failure occurs.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-157381, filed Aug. 24, 2018, which is hereby incorporated by reference herein in its entirety.

What is claimed is:

1. An electrical contact spring for an image forming apparatus, comprising:

a compression spring portion formed of a coiled wire rod and configured to be compressed and deformed; and a contact portion having a circular shape and provided on one side of the compression spring portion in an axis direction thereof, wherein the contact portion has a ring shape portion, which is formed of the wire rod wound into at least a double loop around a first direction intersecting the axis direction, and a winding start portion, which is formed of the wire rod and connects the compression spring portion and the ring shape portion, wherein the ring shape portion has a first arc portion on a side of the compression spring portion, a second arc portion on a side opposite to the compression spring portion in the axis direction, and two straight lines connecting respective ends of the first arc portion to respective ends of the second arc portion, a width of the second arc portion is greater than a width of the first arc portion in a second direction intersecting the axis direction and the first direction, and wherein when viewed in the first direction, an end portion of the winding start portion connecting to the ring shape portion is located at a position closer to the second arc portion than to the first arc portion.

2. The electrical contact spring according to claim 1, wherein the contact portion further has a winding end portion continuous from the ring shape portion and formed of the wire rod, wherein a part of the winding end portion is located inside a coiled cylindrical portion of the compression spring portion, and wherein the part of the winding end portion is brought into contact with the compression spring portion when the ring shape portion tilts, to prevent the ring shape portion from protruding from coiled the cylindrical portion.

3. The electrical contact spring according to claim 1, wherein the contact portion further has a winding end portion continuous from the ring shape portion and formed of the wire rod, and wherein an end portion of the winding end portion is located inside a maximum width of the ring shape portion and provided at a position closer to the compression spring portion than to a position at the maximum width of the ring shape portion.

4. The electrical contact spring according to claim 1, wherein the contact portion further has a winding end portion continuous from the ring shape portion and formed of the wire rod, and wherein the winding start portion and the winding end portion are located outside the ring shape portion when viewed in the second direction, and extend in the axis direction.

5. The electrical contact spring according to claim 1, wherein a first width that is a maximum width of the ring shape portion is larger than a second width of the ring shape portion on the compression spring portion side.

6. An electrical contact member, comprising:

the electrical contact spring according to claim 1; and a holding member configured to hold the electrical contact spring, wherein the holding member has a slit hole in which the ring shape portion is slidable.

7. An electrical contact member, comprising:

the electrical contact spring according to claim 1; and a holding member configured to hold the electrical contact spring, wherein the holding member contains the compression spring portion therein, and holds the electrical contact spring so as to allow the ring shape portion to protrude.

8. An image forming apparatus comprising:

the electrical contact spring according to claim 1; and a cartridge having an electrical contact and provided for forming an image, wherein a voltage is supplied by contacting the contact and the ring shape portion.

9. An electrical contact spring for an image forming apparatus, comprising:

a compression spring portion formed of a coiled wire rod and configured to be compressed and deformed; and a contact portion having a circular shape and provided on one side of the compression spring portion in an axis direction thereof, wherein the contact portion has a ring shape portion formed of the wire rod wound into at least a double loop in a first direction intersecting the axis direction, wherein the contact portion further has a winding end portion continuous from the ring shape portion and formed of the wire rod, wherein a part of the winding end portion is located inside a coiled cylindrical portion of the compression spring portion, and wherein the part of the winding end portion is brought into contact with the compression spring portion when the ring shape portion tilts, to prevent the ring shape portion from protruding from the coiled cylindrical portion.

10. The electrical contact spring according to claim 9, wherein a region including an overlap of the wire rod of the ring shape portion is 70% or less of the entire ring shape portion when viewed in the first direction.

11. The electrical contact spring according to claim 9, wherein the contact portion further has a winding end portion continuous from the ring shape portion and formed of the wire rod, and wherein an end portion of the winding end portion is located inside a maximum width of the ring shape portion and provided at a position closer to the compression spring portion than to a position at the maximum width of the ring shape portion.

12. The electrical contact spring according to claim 9, wherein the contact portion further has a winding end portion continuous from the ring shape portion and formed of the wire rod, and wherein the winding start portion and the winding end portion are located outside the ring shape portion and extend in the axis direction when viewed in a second direction intersecting the axis direction and the first direction.

13. The electrical contact spring according to claim 9, wherein a first width that is a maximum width of the ring shape portion is larger than a second width of the ring shape portion on the compression spring portion side.

14. An electrical contact member comprising:

the electrical contact spring according to claim 9; and a holding member configured to hold the electrical contact spring, wherein the holding member has a slit hole in which the ring shape portion is slidable.

15. An electrical contact member comprising:

the electrical contact spring according to claim 9; and a holding member configured to hold the electrical contact spring, wherein the holding member contains the compression spring portion therein, and holds the electrical contact spring so as to allow the ring shape portion to protrude.

16. An electrical contact member comprising:

the electrical contact spring according to claim 9; and a cartridge having an electrical contact and provided for forming an image, wherein a voltage is supplied by contacting the contact and the ring shape portion.

* * * * *